US006179351B1

(12) United States Patent
Stendal

(10) Patent No.: US 6,179,351 B1
(45) Date of Patent: Jan. 30, 2001

(54) LOCKING DEVICE

(76) Inventor: Jan Stendal, Flodinsgatan 17, SE722 18, Västerås (SE)

( * ) Notice: Under 35 U.S.C. 154(b), the term of this patent shall be extended for 0 days.

(21) Appl. No.: 09/397,235

(22) Filed: Sep. 16, 1999

Related U.S. Application Data

(63) Continuation of application No. PCT/SE98/00236, filed on Feb. 12, 1998.

(51) Int. Cl.[7] ..... E05C 1/02
(52) U.S. Cl. ..... 292/137; 292/341.17; 292/335
(58) Field of Search ..... 292/DIG. 49, 341.13, 292/341.12, 340, 341.17, 341.15, 334, 335, 305, 137, 240

(56) References Cited

U.S. PATENT DOCUMENTS

| | | | | |
|---|---|---|---|---|
| 2,128,014 | * | 8/1938 | Platin | 292/341.17 |
| 2,687,911 | * | 8/1954 | Burke | 292/341.17 |
| 2,868,577 | * | 1/1959 | Zingone | 292/335 |
| 3,390,908 | * | 7/1968 | Schlage | 292/195 |
| 3,442,543 | * | 5/1969 | Weyman | 292/340 |
| 4,056,277 | * | 11/1977 | Gamus et al. | 292/346 |
| 4,595,220 | * | 6/1986 | Hanchett, Jr. et al. | 292/341.17 |
| 4,626,010 | * | 12/1986 | Hanchett, Jr. et al. | 292/341.17 |
| 4,632,440 | * | 12/1986 | Adrian et al. | 292/229 |
| 5,257,841 | * | 11/1993 | Geringer et al. | 292/340 |
| 5,757,269 | * | 5/1998 | Roth et al. | 292/340 |
| 5,782,509 | * | 7/1998 | Uyeda | 292/341.17 |
| 5,825,288 | * | 10/1998 | Wojdan | 292/340 |

* cited by examiner

*Primary Examiner*—Lynne H. Browne
*Assistant Examiner*—John B. Walsh
(74) *Attorney, Agent, or Firm*—Thomas R. Vigil

(57) ABSTRACT

The present invention relates to a locking device with movable indicator (4, 5) for sensing the "door closed" or "door open" position of a dead-bolt, provided with a pivotably journalled rotating cam (2) (securing plate) intended to be moved between open and locked position by the released dead-bolt (8). The invention is characterized in that the rotating cam (2) and the indicator are mutually connected by means of a spring, e.g. a tension spring (1) arranged in closed, locking position to produce a force component in the closing direction of the rotating cam, and upon removal of the dead-bolt (8) from the rotating cam, i.e. when the door is opened by means of the indicator, to be displaced in relation to the centre (3) of rotation of the rotating cam so that a force component is obtained in opening direction and the rotating cam is turned to opening position by a snap action of the spring.

2 Claims, 2 Drawing Sheets

LOCKING DEVICE

This application is a continuation of PCT/SE98/00236 filed Feb. 12, 1998.

TECHNICAL FIELD

The present invention relates to a locking device with a movable indicator for sensing the "door closed" or "door open" position of a dead-bolt, provided with a pivotably journalled rotating cam (securing plate) intended to be moved between open and locked position by the released dead-bolt.

1. Background Art

A known lock comprises a lock case and a rotating cam (securing plate) with a U-shaped recess for a protruding dead-bolt. The rotating cam is pivotable about a shaft. A distinct movement is desirable for the rotating cam between locked and open position and it may be difficult to achieve this movement in certain positions of the axis of rotation of the rotating cam. See U.S. Pat. No. 3,861,727, for instance.

2. Description of the Invention

The object of the invention is to provide a solution to these and other associated problems of obtaining a secure and distinct locking action. The locking device according to the invention is characterized in that the rotating cam and the indicator are mutually connected by means of a spring, e.g. a tension spring, arranged in closed locking position to produce a force component in the closing direction of the rotating cam, and upon removal of the dead-bolt from the rotating cam, i.e. when the door is opened by means of the indicator, to be displaced in relation to the centre of rotation of the rotating cam so that a force component is obtained in opening direction and the rotating cam is turned to opening position by a snap action of the spring. This device gives a secure and distinct locking and opening action and a clear indication of whether the device is in locked or open position. Another advantage is that this lock requires only a small amount of space for fitting and placing.

BRIEF DESCRIPTION OF THE DRAWINGS

The invention is described by way of example in the accompanying drawings, in which.

DESCRIPTION OF EMBODIMENT

Figure 1:
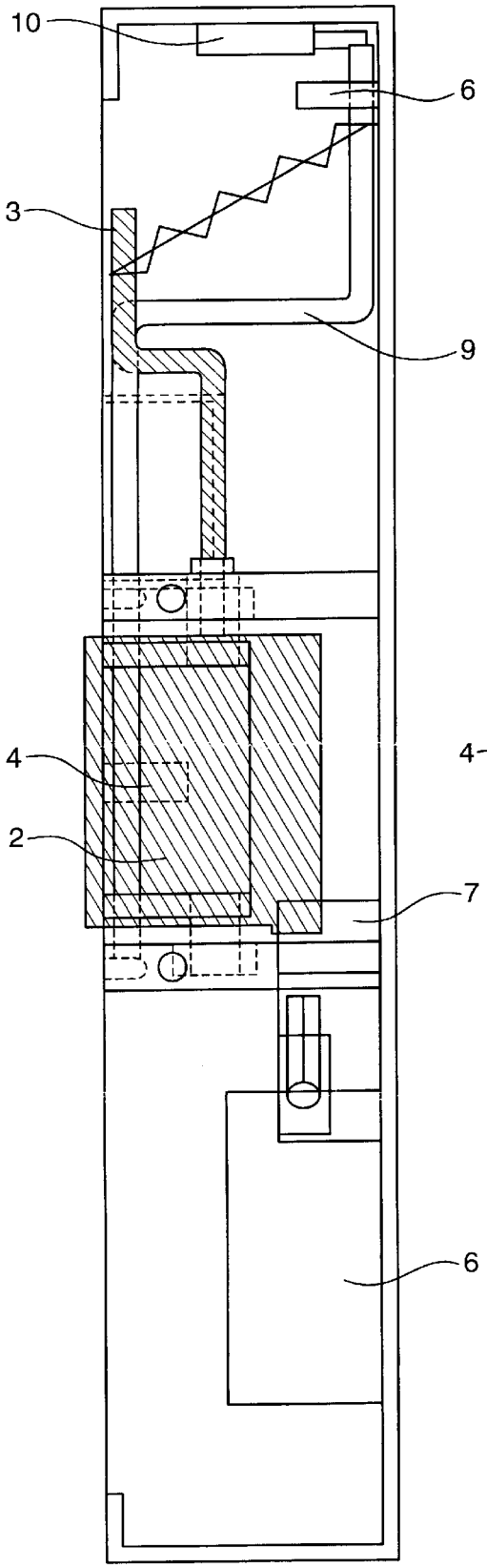
FIG. 1 shows a locking device seen from the side and FIG. 2 the same, seen from above.
Figure 2:
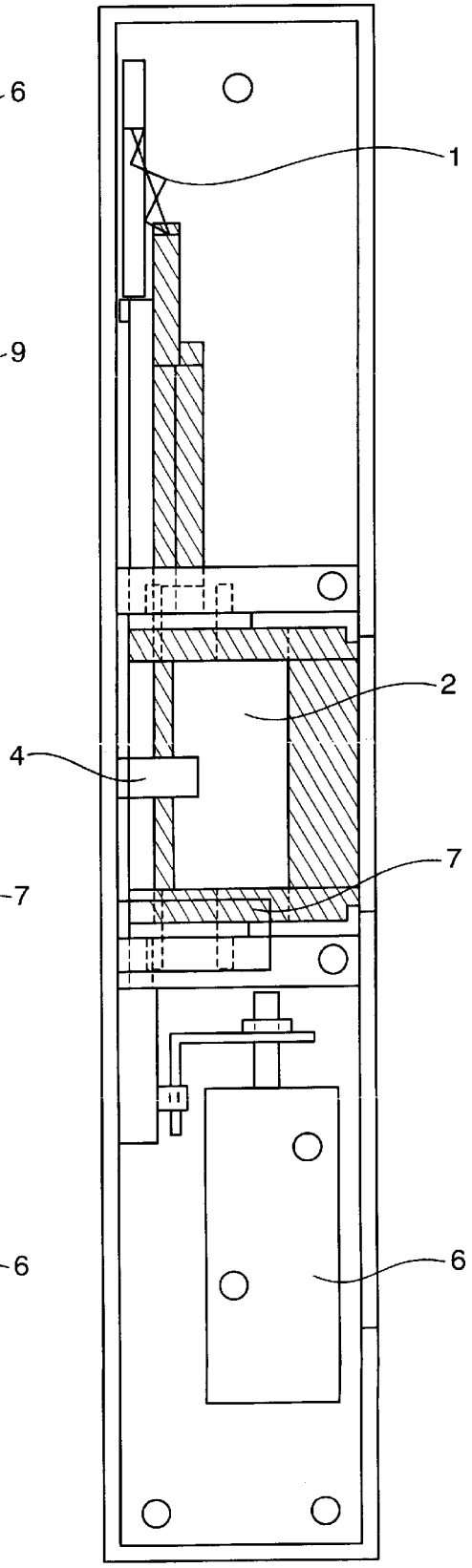

FIGS. 1 and 2 show a locking device according to the invention, provided with a rotating cam (2) with an extended shaft (3), an indicator (3, 4, 5), and an electromagnet (6) for operation of a ratchet (7). (8) is a dead-bolt (see FIGS. 3 and 5) and (5) is a stop. (10) is the actual microswitch included in the indicator. The cam (2) has a recess or cavity (2A) therein, as shown in FIGS. 2–5 for receiving the dead bolt (8).

Figure 3:
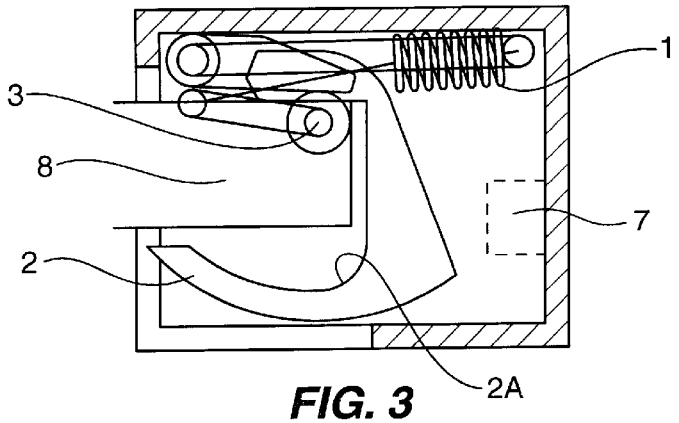
FIG. 3 shows the lock in locked position, FIG. 4 in a temporarily passed intermediate position and FIG. 5 in open position.
Figure 4:
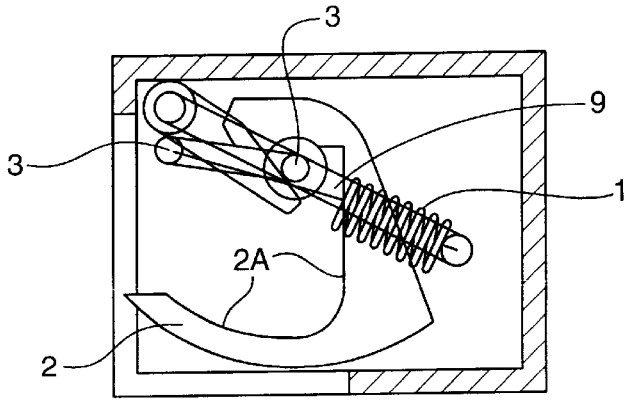
Figure 5:
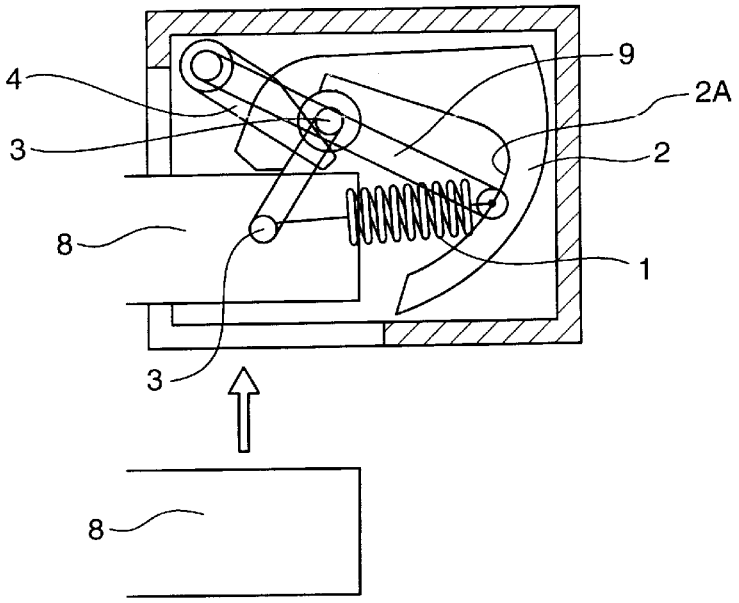

FIG. 3 shows the rotating cam (2) locked in position by the dead-bolt (8). (3) is the shaft of the rotating cam and (1) is a tension spring connecting the indicator (4) with the rotating cam (2, 3) (see also FIG. 1). In locked position (FIG. 3) the spring (1) is arranged so that a force component acts in locking direction of the rotating cam. If the dead-bolt is removed, the spring is moved with the indicator so that the centre of rotation of the rotating cam is passed (see FIG. 4). A force component is now obtained in opening direction on the rotating cam (2) from the spring (1) and the rotating cam snaps to the open position shown in FIG. 5. See the coupling between the shaft (3) of the rotating cam and the shaft of the indicator (4) in FIG. 1.

In a locking action the dead-bolt is moved in towards the rotating cam, said equilibrium is passed and a locking force component is obtained. This movement also takes place with a snap action. (See FIG. 5.)

(10) is a microswitch pertaining to the indicator, which senses the position (locked or open) of the dead-bolt (8).

The electromagnet (single or double-acting) controls a ratchet device (7), see FIGS. 1 and 2, and a space for this can be obtained as shown in FIG. 3.

The device described above can be varied in many ways within the scope of the following claims.

What is claimed is:

1. A locking device comprising:

an indicating member (4,5) and a first shaft (9) connected to said indicating member (4), said indicating member (4) being arranged in said locking device such that, during a closing operation, a dead bolt (8) of a door acts against, and moves said indicating member (4) thereby causing said first shaft (9) to rotate, a pivotably arranged cam (2) which is movable between an open position and a closed position by rotation about an axis of rotation, said cam (2) being connected to a second shaft (3), said cam (2) also being arranged such that during a closing operation, said dead bolt (8) also acts against a portion of said cam (2) and moves said cam in a closing direction, thereby causing said second shaft (3) to rotate, and, said first shaft (9) and said second shaft are mutually connected by a spring (1), said spring (1) being arranged such that in said closed position said spring produces a force component on said second shaft (3) which acts in the closing direction of said cam, and such that when said dead bolt (8), during an opening operation, is removed from said closed position, the position of said spring (1) relative to said axis of rotation of said cam (2) is changed such that said spring (1) produces a force on said second shaft (3) which acts to turn said cam (2) to said position with a snap action of said spring.

2. A locking device as claimed in claim 1, comprising sensing means for detecting when said dead bolt is in said closed position or said open position.

* * * * *

UNITED STATES PATENT AND TRADEMARK OFFICE

CERTIFICATE OF CORRECTION

PATENT NO. : 6,179,351 B1
DATED : January 30, 2001
INVENTOR(S) : Jan Stendahl

It is certified that error appears in the above-identified patent and that said Letters Patent is hereby corrected as shown below:

Title page,
After:
"[63] Continuation of application No. PCT/SE98/00236, filed on 2/12/98"
Insert:
-- [30] Foreign Application Priority Data
March 17, 1997 (SE).....9700962-5 --

Signed and Sealed this

Twenty-third Day of October, 2001

*Attest:*

Nicholas P. Godici

NICHOLAS P. GODICI
*Acting Director of the United States Patent and Trademark Office*

*Attesting Officer*